US006030519A

United States Patent [19]

Keller et al.

[11] Patent Number: 6,030,519

[45] Date of Patent: Feb. 29, 2000

[54] ELECTRODE PAD FOR DEBONDING PAINT FROM A METAL SUBSTRATE

[76] Inventors: Rudolf Keller, 4221 Roundtop Rd., Export, Pa. 15632; Brian J. Barca, 1102 Cochrans Mill, Clairton, Pa. 15025; Daniel M. Hydock, 3143 Vermont Dr., Lower Burrell, Pa. 15068

[21] Appl. No.: 09/109,888

[22] Filed: Jul. 6, 1998

[51] Int. Cl.[7] ..... C25F 1/00

[52] U.S. Cl. ..... 205/705; 205/709; 205/712; 205/741

[58] Field of Search ..... 205/705, 709, 205/712, 741; 204/297 R

[56] References Cited

U.S. PATENT DOCUMENTS

| | | | |
|---|---|---|---|
| 1,917,022 | 7/1933 | Dunn | 204/72 |
| 2,643,222 | 6/1953 | Cox | 204/145 R |
| 2,765,267 | 10/1956 | Dorst | 204/1.11 |
| 3,457,151 | 7/1969 | Kortejarvi | 204/130 |
| 3,823,080 | 7/1974 | Speigel | 204/141.5 |
| 3,900,376 | 8/1975 | Copsey et al. | 204/141.5 |
| 4,213,839 | 7/1980 | Azzerri | 204/180.2 |
| 4,439,289 | 3/1984 | Viglione | 204/146 |
| 4,493,756 | 1/1985 | Degen et al. | 204/141.5 |
| 5,104,501 | 4/1992 | Okabayashi | 204/141.5 |
| 5,232,563 | 8/1993 | Warfield | 204/141.5 |
| 5,507,926 | 4/1996 | Keller et al. | 205/705 |
| 5,776,330 | 7/1998 | D'Muhala | 205/705 |

OTHER PUBLICATIONS

ASTM Designation: G95–87, Standard Test Method for Cathodic Disbondment Test of Pipeline Coatings (Attached Cell Method), pp. 635–638, no date available.

ASTM Designation: G8–90, "Standard Test Methods for Cathodic Disbonding of Pipeline Coatings",, pp. 564–571, no date available.

*Primary Examiner*—Arun S. Phasge
*Attorney, Agent, or Firm*—Andrew Alexander

[57] ABSTRACT

A method of electrolytically separating a paint coating from a metal surface comprising the steps of providing a metal member having a surface having a paint coating thereon and contacting the member with an essentially neutral electrolytic solution. The metal member is made cathodic in an electrolytic cell and current is passed from an anode electrode pad through the electrolytic solution to the metal member for a time sufficient to cause the paint coating to separate from the metal member. The pad is comprised of a first blanket for contacting the paint coating, a second blanket to cover the first blanket and an electrode mesh positioned between the first and second blankets.

14 Claims, 4 Drawing Sheets

ELECTRODE PAD FOR DEBONDING PAINT FROM A METAL SUBSTRATE

BACKGROUND OF THE INVENTION

This invention relates to paint removal from metal members such as metal parts, objects and structures and more particularly, it relates to an anode electrode pad for electrolytically assisted removal of paint from large structures such as bridge structures, tanks, ships, airplanes, automobiles and the like.

Prior methods of removing paint from large metal surfaces such as surfaces of steel bridge structures and holding tanks include abrasive blasting and chemical stripping. However, abrasive methods have the problem that they result in large amounts of the fragmented paint becoming airborne. This is particularly hazardous when the paint contains heavy metal compounds such as lead and chromate. Environmental regulations provide for stringent controls on the amount of metal such as lead that can escape into the atmosphere or onto surface soil and water. Contamination of water such as river water with paint is particularly troublesome because the metals in the paint can find their way into drinking water. To avoid this type of contamination when blasting, for example, attempts have been made to use enclosures around the structures to be blasted. However, such enclosures tend to be awkward and costly to use and often do not contain the abrasive and paint particles sufficiently well. Thus, hazardous quantities of the paint can still escape into the atmosphere and find their way to the soil and drinking water. Another area of concern is in the removal of paint from metal in confined areas, e.g., in the interior of a ship or in a food processing plant, where neither airborne particles nor fines are acceptable. In addition, abrasive blasting presents occupational hazards, and personnel must be protected from inhaling and contacting toxic paint constituents. Thus, in order to avoid contamination of the environment, abrasive blasting requires expensive precautions in an attempt to comply with environmental and health regulations. In the case of plastic media blasting of aircraft paints, chromate contaminates the blasting media, making disposal an environmental problem.

Another approach to removing paint coatings from metal structures involves the use of organic solvents or caustic solutions for chemical stripping. While the solvents can be effective in removing paint, they contaminate the environment upon evaporation and the escape of volatile organic compounds is restricted by law. Further, solvents have the problem of disposal after being used. The use of caustic solutions has the disadvantage that they are hazardous and require long and weather-dependent soak times to be effective. Thus, there is a great need for a system that avoids these problems.

In U.S. Pat. No. 5,507,926, incorporated herein by reference, there is disclosed a method of electrolytically separating paint coating from a metal surface comprising the steps of providing a metal member having a surface having a paint coating thereon and contacting the member with an essentially neutral electrolytic solution. The metal member is made cathodic in an electrolytic cell and current is passed from an anode through the electrolytic solution to the metal member for a time sufficient to cause the paint coating to separate from the metal member. However, it was discovered that such process while efficient, resulted in areas where debonding did not occur. Thus, there is a great need for an improved process which will operate to uniformly remove or separate the paint coating from the substrate.

In prior work, the use of electrochemical processes has been suggested for cleaning of metals. For example, Dunn U.S. Pat. No. 1,917,022 suggests the use of an electrochemical process for cleaning metal wherein the work is subjected to electrolytic action in a simple non-cyanide alkaline bath in the presence of metallic ions. According to Dunn, the work may be made either anode or cathode and in either case the dirt is subjected to three distinct cleaning actions; namely, the chemical detergent effect of the alkaline solution; the saponification and emulsification effect; and the mechanical action resulting from the liberation of gases at the work surface. Further, Dunn notes that while the metallic ion concentration may be inaugurated and maintained by the addition to the electrolyte of metal salts such as salts of lead, tin, zinc or cadmium, it is preferred to introduce ions by anodic action on the electrodes. According to Dunn, certain metals will have characteristic advantages and disadvantages. In the case of lead, lead peroxide forms at the anode and with the use of tin, metastannic acid forms. However, the Dunn reference has the disadvantage that it requires an alkaline bath and the addition of heavy metal ions such as lead or cadmium, further aggravating the environmental problem.

U.S. Pat. No. 3,900,376 discloses cleaning metal surfaces of elongated metal articles such as rods, bars, strips and wire. The metal articles are passed through an electrolyte such that a gas, e.g., hydrogen, is evolved at the metal surface. A high voltage is applied between the article and an inert anode such that the surface of the article in the electrolyte is completely covered by gas and vapor through which a discharge passes. However, the operation has to be carried out in the region of the current minimum of the current/voltage characteristic which occurs beyond the normal electrolysis regime as the voltage is increased. According to the patent, the high voltage and high current density cause substantial heat generation and the surface of the article is covered with a layer containing both hydrogen and steam. The discharge through the gas and vapor layer causes any scale on the article to flake off.

U.S. Pat. No. 2,765,267 discloses a process for stripping flexible films of resin which adhere to underlying metal bases to produce unsupported dielectric layers. The insulating layers are removed from the underlying bases by an electrolytic process in which the base metal is made the cathode in an electrolytic cell, and the insulating layer is forced off the base metal by the pressure of gaseous hydrogen at the junction between the metal and insulation, a distinctly different action than used in the present invention.

U.S. Pat. No. 3,457,151 discloses cleaning of an article made of conductive and nonconductive materials such as a printed circuit board, in an electrolytic bath and causing a current to flow in the bath between a cathodic element closely adjacent the board and an anodic element. The scrubbing action of the hydrogen bubbles generated at the cathodic element and at the conductive portions of the board cleans all of the surfaces.

U.S. Pat. No. 3,823,080 discloses an electrolytic process for removing a coating from a cathode ray tube mask member, and U.S. Pat. No. 4,439,289 discloses an electrolytic method for removal of magnetic coatings from computer memory disc using a sulfuric acid and glycerin solution.

ASTM Designation G95-87, "Standard Test Method for Cathodic Disbondment Test of Pipeline Coatings" and ASTM Designation G8-90 "Standard Test Methods for Cathodic Disbonding of Pipeline Coatings" disclose test methods that cover accelerated procedures for simultaneously determining comparative characteristics of insulating coating systems applied to steel pipe exterior for the purpose of preventing or mitigating corrosion that may occur in underground service where the pipe will be in contact with inland soils and may or may not receive cathodic protection.

Other electrolytic cleaning methods are disclosed in U.S. Pat. Nos. 4,493,756; 5,104,501 and 5,232,563. However, it will be seen that there is still a great need for a process for removing paint coatings from metal members such as steel structures, automobiles and aircraft, which does not permit contamination of the environment with heavy metal components such as lead or chromium compounds contained in the protective coating.

SUMMARY OF THE INVENTION

It is an object of the invention to provide an improved process for removing paint coatings from metal surfaces.

It is another object of the invention to provide an improved electrolytically assisted process for removing paint coatings from metal surfaces.

Yet, it is another object of the invention to provide an improved electrolytic process for removing paint coatings from metal surfaces using an electrolyte with a substantially neutral pH.

And yet, it is another object of the invention to provide an improved electrolytic process for removing paint coatings from metal surfaces which avoids contamination of the environment with caustic or organic chemicals or heavy metals contained in airborne paint dust.

It is still another object of the invention to provide an improved electrode blanket or pad for electrolytically assisted paint removal from a metal surface.

It is yet another object of the invention to provide an improved electrode blanket or pad which facilitates more uniform removal of paint from metal substrates using the electrical process of the invention.

Still, it is another object of the invention to provide a system for more uniform contact of said electrode blanket or pad with said painted surface for purposes of uniformly debonding the paint coating.

These and other objects will become apparent from a reading of the specification and claims appended hereto.

In accordance with these objects, there is provided an improved method for electrolytically debonding a paint coating from a metal member wherein the paint coating is bonded to a surface of the metal member and an improved electrode blanket for debonding paint coatings. The electrode blanket is comprised of a first blanket for contacting the paint coating, a second blanket for covering the first blanket, and an electrode mesh positioned between the first blanket and the second blanket. A grid is positioned on the outside surface of the second blanket to maintain the first blanket in contact with the paint coating; it is held in place by magnets attached to the grid or by mechanical means. In the method, an aqueous based electrolyte solution is applied to the electrode blanket, the second blanket maintaining substantially uniform presence of electrolyte in the first blanket, thereby avoiding dry spots and the problems associated therewith. An electric current is passed from the electrode of the blanket to the metal member, making the electrode blanket anodic and the metal member cathodic. The current is passed for a time sufficient to cause the paint coating to debond from the surface of the metal member without substantially chemically altering the paint coating.

DETAILED DESCRIPTION OF PREFERRED EMBODIMENTS

The present invention has particular application to water tanks, bridge structures, aircraft and ships because it assures absence of dust emissions which is prevalent with the use of abrasive blasting. Further, the present invention is particularly suitable for removal of paints from such tanks or structures thereby containing the removed paint constituents without fear of contaminating soil, surface water or air with heavy metals such as lead which may be contained in such paint. It will be appreciated that older structures often contain lead in paints and such paints can still be present on such structures even if re-painted since often it was commonplace to paint over the old paint coatings. In the present invention, there is no need for heavy equipment usually attendant the use of abrasive blasting, enclosures to contain the dust inherent in abrasive blasting, or the use of dust masks by personnel conducting the paint removal operation. Further, the present invention is highly suitable for use in confined spaces such as the interior of ships such as Navy ships and in food processing plants.

Figure 1:
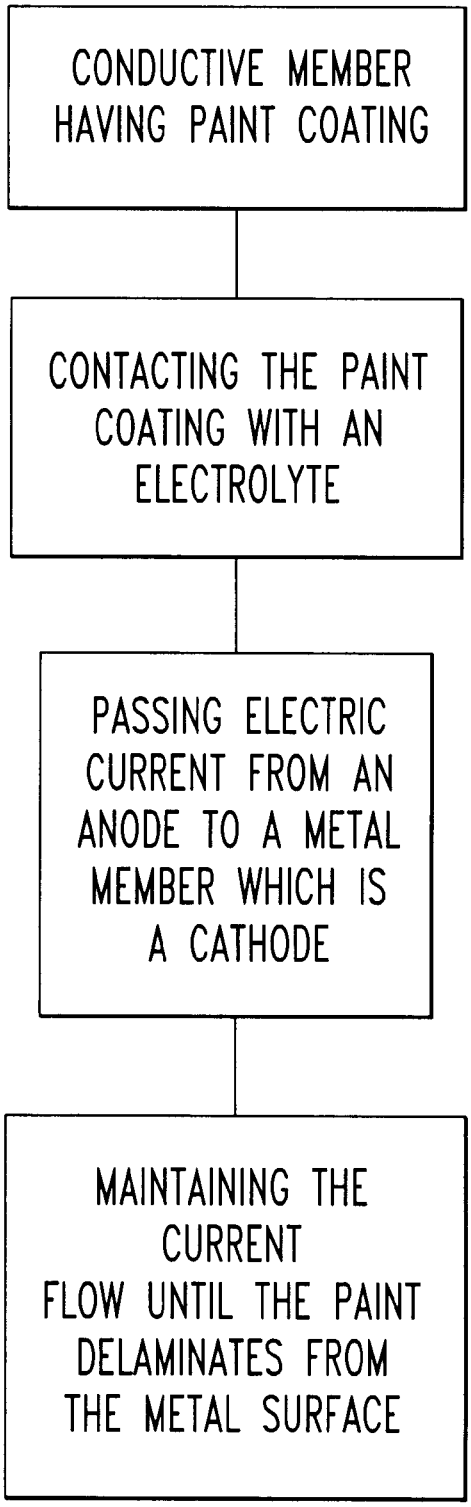
FIG. 1 is a flow chart illustrating steps in the invention.

Briefly, in the present invention, the metal surface from which paint is to be removed is contacted with an electrolytic solution to set up an electrochemical cell wherein the metal surface is made cathodic. An anode is associated with the electrolytic solution to complete the cell, and current is passed between the anode and cathode for a time sufficient for the paint to delaminate or separate from the metal surface (FIG. 1).

For purposes, of the present invention, the electrolytic solution can be any water-based electrolytic solution that is compatible with the metal substrate containing the paint coatings to be removed. The pH of the solution can range from very acidic, e.g., pH of 1 or 2, to very alkaline, e.g., pH of 12 or 13. In certain instances, it is preferred that the solution is utilized at a substantially neutral unbuffered pH and does not contain any metals that can be cathodically reduced in appreciable quantities. Thus, the electrolyte of the present invention does not further contaminate the environment by the use of heavy metals and the like. The electrolyte can comprise a material selected from $Na_2SO_4$, $K_2SO_4$, $Na_3PO_4$, $K_3PO_4$ and NaCl. Preferably, the electrolyte is comprised of single salt. While the electrolyte can be highly alkaline, the preferred electrolyte is substantially neutral. Further, preferably, the electrolyte is a chloride-free electrolyte.

The material can be present in the electrolytic solution in the range of 0.01 to 3 mols/l and preferably in the range of 0.1 to 0.7 mols/l with a typical amount being about 0.4 to 0.6 mols/l to provide for the required levels of conductivity.

Preferably, the electrolytic solution has a substantially neutral pH. However, the electrolytic solution can have a pH in the range of 3 to 10 and preferably a pH in the range of about 5 to 9. Typically, the pH ranges from about 6 to 8. By the term "substantially neutral pH" is meant a pH range of 3 to 10, preferably 5 to 9 and typically 6 to 3.

The temperature at which the method can be used can range from −5 to 60° C., but preferably the electrolytic solution is used at or about ambient temperature. Thus, it will be seen that the method has the advantage that it is not sensitive to weather conditions above freezing.

While the inventors do not wish to be bound by any theory of invention, it is believed that the separation or debonding of the paint from the metal surface is primarily chemical in nature. The cathodic reaction such as hydrogen evolution causes a localized higher pH which reacts to debond the coating. Debonding is not primarily caused by stirring or other physical action as occasioned by gas evolution.

Figure 2:
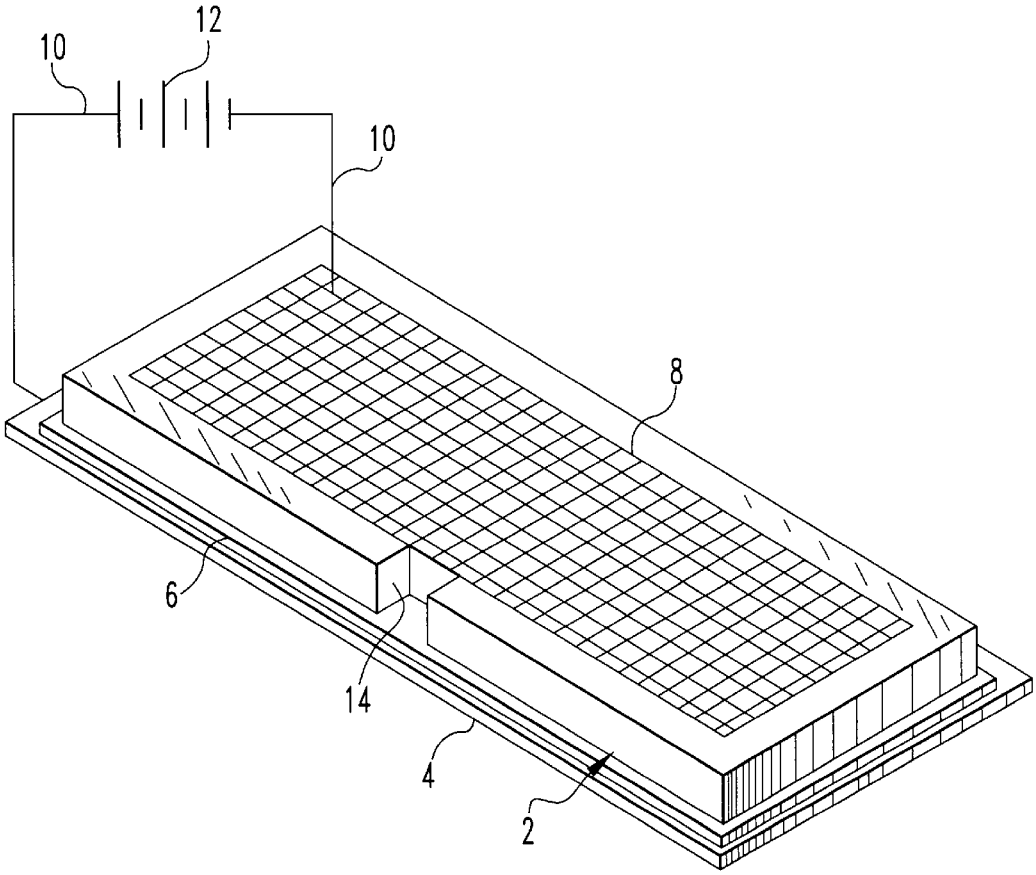
FIG. 2 shows a paint metal substrate having the contacting electrolyte contained in a layer or blanket in contact with the metal substrate.

As noted, the metal surface from which the paint coating is separated or delaminated is made the cathode in an electrolytic cell and the paint coating is contacted on the metal surface by the electrolytic solution. Small objects can simply be dipped into such a solution. When the delaminating or debonding of the paint surface of a large object, such as a bridge structure, a water tower or ship, is required to be performed in situ, the contact of the surface with electrolyte may be accomplished utilizing a blanket 2 (FIG. 2) saturated with electrolytic solution. In FIG. 2, there is shown a painted metal substrate 4 having a pad or blanket 2 in contact therewith. Blanket 2 may be comprised of any absorbent material that can be saturated with electrolytic solution such that electric current can be passed through the electrolyte. Examples of such blanket materials include: SORB-X, available from Matarah Industries, Inc., Milwaukee, Wis., or other spill control materials or other "hydrophyllic" blanket materials such as those available from SPC, Somerset, N.J., or sponge mats available from BREG International, Fredericksburg, Va., all referred to herein as blanket material. As shown in FIG. 2, blanket 2 may have a paper or cloth layer 6 permeable by the electrolyte. Further, paper or cloth layer 6 may have a surface thereof coated with an adhesive which contacts the paint coating. Thus, when the paint coating debonds from the metal surface, it becomes firmly attached to the adhesive. After treatment, the paper layer may be removed with paint fragments to be processed for recovery of metals in the paint. Gaps 14 may be incorporated in larger size blankets to facilitate escape of gas, if the cathodic reaction produces gas such as hydrogen. In addition, blanket 2 may be provided with an electrode mesh 8 such as a wire mesh which can serve as an anode. The anode and cathode are connected by electrical connectors 10 to an electric power source 12 which supplies DC current to the electrodes. It is preferred that electrode mesh 8 be comprised of a flexible material to permit blanket 2 to be wrapped around sharp structures such as beams comprising the bridge structure. Blanket 2 may be held in contact with the painted metal surface by any means that permits electrolytic communication with the painted surface. Magnets, retainers or shrink wrapping may be utilized to bring the blanket in contact with the surface.

The anode, as noted, may be comprised of any material that permits electrical contact with the electrolyte and passes current to the cathode to preferably evolve oxygen. Thus, the anode may comprise a metal mesh such as a steel, nickel, stainless steel, graphite screen or cloth, titanium or other materials suitable for anodic use. A suitable material is expanded low-carbon steel sheet available from Exmet Corporation, Nangatuck, Conn.

It will be appreciated that a wide range of electrolytes can be used in conjunction with blanket 2 because substantially all of the electrolytic compounds are contained in blanket 2 during the debonding operation. Thus, almost any suitable electrolyte is contemplated for use with blanket 2. Further, the bonding operation can be carried out to remove paint coatings from any metallic substrate, including but not limited to iron, aluminum, copper, magnesium and titanium based alloys. When debonding paint coatings from aluminum, for example, it may be desirable to use an inhibitor in the electrolytic solution in order to prevent attack of aluminum substrate during the debonding operation.

When the electrolyte is in contact with the painted metal surface, a current density is passed at a rate that promotes debonding or delamination of the paint coating from the metal surface. Thus, a current density in the range of 100 to 2000 amps/$m^2$ may be used with a preferred current density being in the range of 500 to 1000 amps/$m^2$.

The time for which the electric current is applied can vary depending on the paint coating and the difficulty of debonding. Thus, the time for which the electric current is applied is that which causes debonding. Such times can range from 5 to 120 minutes, preferably 5 to 60 minutes.

After the paint coating debonds, it can be collected and processed in a controlled manner to permit recovery of heavy metals. It should be noted that the paint coating debonds without substantially chemically altering the paint coating.

Figure 3:
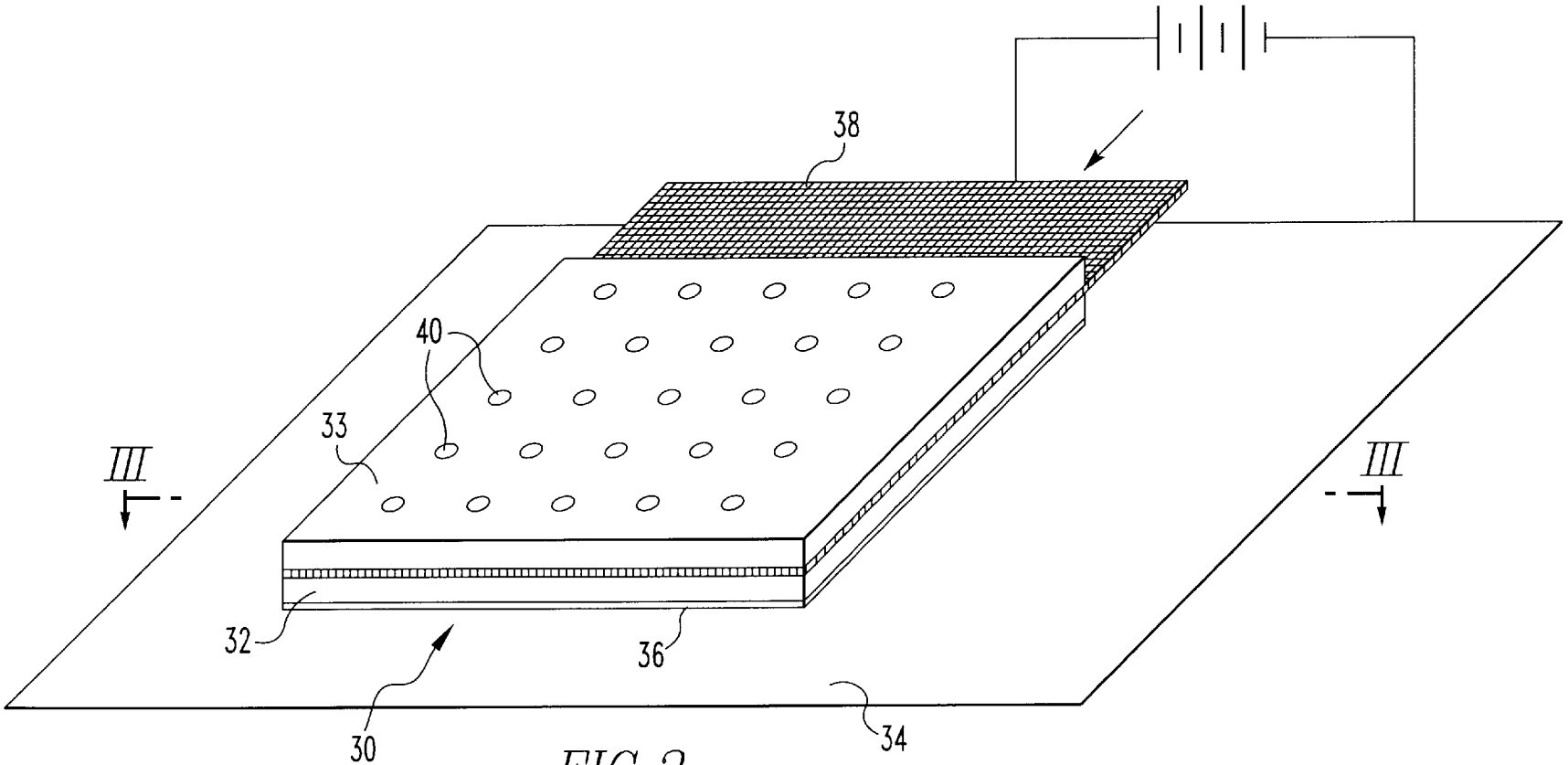
FIG. 3 shows an improved electrode pad or blanket for forming an electrolytic cell in conjunction with a painted metal surface.
Figure 4:
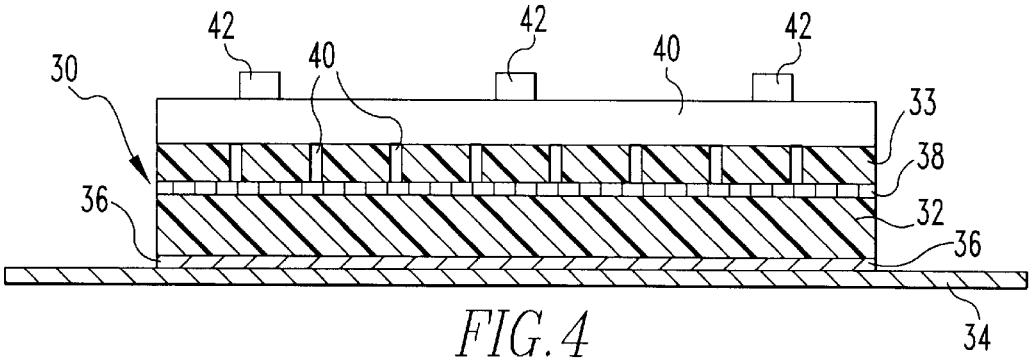
FIG. 4 illustrates a cross section of the improved blanket of FIG. 3 along the line III—III.

In another aspect of the invention, an improved pad or blanket, referred to herein as an electrode pad or blanket 30, is provided as shown in FIGS. 3 and 4. In FIG. 3 there is shown a metal substrate 34 having a layer of paint thereon. Positioned on substrate 34 is an electrode pad or blanket 32 comprised of several layers to facilitate uniform removal or debonding of paint adhering to the substrate. The electrode pad or blanket can comprise a paper or cloth layer 36 permeable by electrolyte. As noted earlier, paper or cloth layer 36 may have the surface in contact with the paint surface coated with an adhesive. Thus, after the debonding treatment, the paint layer is removed with the paper.

In this aspect of the invention, electrode blanket 30 is comprised of a first blanket or pad 32 provided on one side electrode mesh 38 and a second blanket or pad 33 which is provided on the opposite or outside of electrode mesh 38, except in areas reserved to apply the current connection. It will be appreciated that blankets 32 and 33 serve to envelope electrode mesh 38. As will be seen from FIGS. 3 and 4, electrode pad or blanket 30 is preferably provided with perforations 40 to facilitate removal of gases such as oxygen away from the anode and hydrogen away from the metal substrate surface. It is important to remove gases to prevent explosions resulting from mixing of hydrogen and oxygen, for example. By electrode mesh is meant a series of wires, for example, which may cross each other as shown in FIG. 3 or a series of wires which may be placed parallel to each other or arranged randomly to provide a continuous conductive element. Any arrangement of members can be used to provide a conductive medium.

Electrode pad or blanket 30 comprising pads or blankets 32 and 33 is an important aspect of the subject invention because it permits uniform removal of paint coatings or layers from metal substrates. Thus, preferably inside pad 32 has a thickness ratio to outside pad 33 in the range of 1:1 to 10:1. That is, inside pad 32 can range in thickness from about the same or equal thickness as outside pad 33 to about 10 times thicker than outside pad 33. It should be understood that if pad 32 is permitted to exceed a certain thickness, the resistance becomes too great, thus interfering with the effectiveness of debonding the paint coating. In a preferred embodiment, inside pad 32 is about one and one-half (1½) to four (4) times as thick as outside pad 33. It should be noted that pads 32 and 33 may be fastened to electrode mesh 38 with suitable fasteners (not shown) to facilitate handling.

Outside pad 33 has the advantage that it prevents dry spots occurring in inside pad 32 under operation aand thus sacrificially gives up liquid to inside pad 32. Presently, it is not fully understood how the dry spots occur. Dry spots result in non-uniform removal or debonding of pain coatings from the substrate. That is, when electrolyte is not present on portions of pad 32, paint is not removed or debonded in that area, requiring further work to remove such paint. It has been discovered that an electrode pad comprising outside pad 33 substantially eliminates premature occurrence of dry spots and greatly aids in the uniform removal of paint coatings.

In another aspect of the invention, it is preferred that the edges of the pads extend slightly beyond the edges of electrode mesh 38 to prevent adjacent pads from shorting on each other. However, one edge may extend as shown in FIG. 3 to aid in attaching electrical connectors from the power source.

Figure 5:
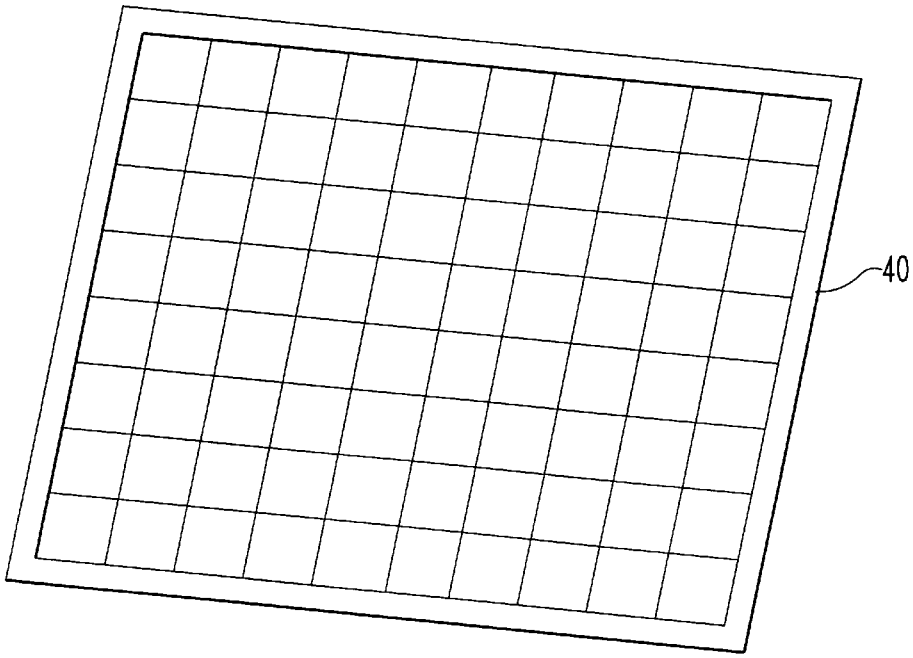
FIG. 5 is a top view of a grid for holding the electrode blanket in position during delamination.

For purposes of holding electrode pad or blanket 30 on a painted flat surface, a grid 40 is provided as shown in FIGS. 4 and 5. The grid and electrode blanket 30 are held in place by means of magnets 42.

Grid 40 is preferably comprised of a flexible material which permits uniform contact of electrode blanket 30 with surfaces, e.g., surfaces with are mildly rounded, such as water towers. Grid 40 can be comprised of any design cross members. However, it is required that grid 40 be formed of an open grid to permit addition of electrolyte periodically. Typically, during operation of debonding, electrolyte solution can be sprayed about every 20 minutes to provide the requisite amount of electrolyte.

Grid 40 can be comprised of any material which can apply uniform pressure to electrode blanket 30. Preferably, grid 40 is comprised of a plastic material such as polypropylene and hard rubber. If plastic material is selected, it should withstand temperatures up to about 180° F., for example, without loosing substantial strength in order to prevent warping and loss of contact with the painted surface. It may be reinforced to prevent warping. It should be noted that heat is generated during the debonding operation. Further, it is preferred that grid 40 is resistant to acids, such as sulfuric acid, generated during the debonding operation.

Grid 40 can have the additional function to facilitate placement of magnets. Magnets can be attached to grid units and do not need to be handled individually.

While the invention has been described with respect to metal surfaces, it should be understood that the invention can be applied to other conductive members such as graphite, carbon-carbon composites, and carbon-epoxy composites or other electrically conductive materials having paint coatings thereon such as used in aircraft. The invention has a special advantage when used with such conductive materials because of the low temperature of application, for example, not exceeding 100° C.

EXAMPLE 1

A test strip having fresh automotive polyester melamine paint coating on a steel substrate was provided with parallel scratches about ½-inch from each other. The scratches penetrated the coating to expose steel. The scratches were provided for purposes of facilitating the treatment, providing electrical continuity to initiate the hydrolysis. The test strip was partially immersed in an aqueous solution at room temperature containing 56.8 g/l sodium sulfate, the solution having a pH of 5. A platinum electrode (anode) was placed in the electrolyte about 5 cms from the flat surface of the test strip which was made a cathode. Constant current was applied between the anode and test strip at a current density of 132 mA/cm$^2$ for 40 minutes. Complete debonding of the paint coating from the steel substrate had occurred where the strip was immersed in the solution.

EXAMPLE 2

For a second test, a rectangular steel tube covered with an aged, incomplete paint coating (rust spots showing) was partially immersed in an aqueous solution containing 0.3 M or 42.62 g/L of sodium sulfate. A platinum electrode (anode) was placed in the solution at room temperature about 3 cms from the steel tube surface, with the steel tube being connected as the cathode. Constant direct current was applied between the anode and the steel tube at an average current density of approximately 38 mA/cm$^2$ (constant voltage of 35V) for 30 minutes. The paint coating was completely debonded from the surface of the steel tube. After the electrolytic treatment, rust spots were converted to a black-colored substance.

EXAMPLE 3

In the third example, a steel substrate having a thick, newly prepared, lead-containing primer coating was covered with a pad soaked with solution containing 0.4 M sodium sulfate (pH of 5). A nickel screen was pressed against the pad on the primer coating utilizing magnets. The nickel screen was made the anode and steel substrate was made the cathode. A direct electrical current was applied between the nickel screen and the steel substrate at a current density of 66 mA/cm$^2$. After applying the electrical current for 20 minutes, the pad was replaced and the current applied for an additional 20 minutes. After this time period, the primer coating had completely debonded.

EXAMPLE 4

In a fourth example, a phosphated steel substrate covered with an automotive polyester melamine paint coating was covered with a SORBX2 pad (Matarah Industries) soaked with a 0.4 M sodium sulfate solution (pH of 5). A nickel screen was pressed against the pad layer on the paint coating utilizing magnets. The nickel screen was made the anode and the steel substrate was made the cathode. A direct electrical current was applied between the nickel screen and the steel substrate at a current density of 66 mA/cm$^2$. After applying the electrical current for 30 minutes, the paint coating had completely debonded.

EXAMPLE 5

In this example, a one-square-foot pad consisting of two layers of SORB-X2 and a low-carbon steel Exmet screen as the anode located between the two layers was applied to a bridge girder that was coated with a lead-based paint. The aqueous solution was the same as in Example 2. A current of 80 amps was applied. The pad was removed after 90 minutes of current flow and the surface cleaned by wiping with moistened paper towels. Complete removal of the paint over the entire area covered by the pad was achieved.

Thus, it will be seen from the examples that paint coatings can be removed effectively from metal substrates providing a paint-free metal surface. The paint fragments are easily collected for proper disposal.

While the invention has been described in terms of preferred embodiments, the claims appended hereto are intended to encompass other embodiments which fall within the spirit of the invention.

What is claimed is:

1. In an improved method for electrolytically debonding a paint coating from a metal member wherein the paint coating is bonded to a surface of the metal member, the improvement comprising:

(a) providing an electrode blanket on said paint coating, said electrode blanket comprised of:
  (i) a first blanket in contact with said paint coating;
  (ii) a second blanket covering said first blanket; and
  (iii) an electrode mesh positioned between said first blanket and said second blanket;

(b) applying an aqueous based electrolyte solution to said electrode blanket, said second blanket maintaining a substantially uniform presence of electrolyte in said first blanket; and (c) passing an electric current through said electrode blanket to said metal member, making said electrode blanket anodic and said metal member cathodic, and passing said current for a time sufficient to cause said paint coating to debond from the surface of said metal member without substantially chemically altering said paint coating.

2. The method in accordance with claim 1 including said first blanket having a thickness ratio to said second blanket in the range of 1:1 to 10:1.

3. The method in accordance with claim 1 including said first blanket having a thickness ratio to said second blanket in the range of 1:5 to 4:1.

4. The method of electrolytically separating a paint coating from a metal surface in accordance with claim 1 including passing the current at a current density in the range of 500 to 1000 amps/$m^2$.

5. The method in accordance with claim 1 wherein said solution contains an environmentally benign electrolyte selected from the group consisting of $Na_2SO_4$, $K_2SO_4$, $Na_3PO_4$, $K_3PO_4$ and NaCl.

6. The method in accordance with claim 5 wherein the solution contains 0.01 to 3 mols/l electrolyte.

7. The method in accordance with claim 1 wherein the solution contains $Na_2SO_4$.

8. The method in accordance with claim 1 including maintaining the bulk electrolyte solution in pH range of 3 to 10.

9. The method in accordance with claim 1 including maintaining the bulk electrolyte solution in a pH range of 6 to 8.

10. The method in accordance with claim 1 including maintaining the bulk electrolyte solution in a pH range of 6.5 to 7.5.

11. The method in accordance with claim 1 including employing an electrolyte solution at about ambient temperature.

12. The method in accordance with claim 1 including positioning a grid on an outside surface of said second blanket to maintain said first blanket in contact with said paint coating.

13. A method of electrolytically debonding a paint coating from a metal member, comprising the steps of:

(a) providing a metal surface of said metal member having a paint coating bonded thereto;

(b) positioning an anode electrode blanket on said paint coating, said electrode blanket comprised of:
  (i) a first blanket in contact with said paint coating;
  (ii) an electrically conductive mesh in contact with said first blanket; and
  (iii) a second blanket in contact with and covering said electrode mesh, the first and second blankets having perforations therein to permit gases formed during debonding to escape through the blanket, said first and second blankets substantially enveloping said conductive mesh, said first blanket having a thickness ratio to said second blanket in the range of 1:1 to 10:1;

(c) maintaining said electrode blanket in contact with said paint coating using a grid;

(d) applying an aqueous based electrolyte solution to said electrode blanket; and (e) passing an electric current from said electrode blanket to said metal member and causing said paint coating to separate from said member.

14. The method in accordance with claim 13 including said first blanket having a thickness ratio to said second blanket in the range of 1.5:1 to 4:1.

* * * * *